US007322564B2

(12) United States Patent
Fakhari

(10) Patent No.: US 7,322,564 B2
(45) Date of Patent: Jan. 29, 2008

(54) ORNAMENTAL FIBERGLASS FENCE

(76) Inventor: John Fakhari, 7909 Wood Harbor Dr., Ft. Worth, TX (US) 76198

( * ) Notice: Subject to any disclaimer, the term of this patent is extended or adjusted under 35 U.S.C. 154(b) by 0 days.

(21) Appl. No.: 11/074,622

(22) Filed: Mar. 8, 2005

(65) Prior Publication Data

US 2006/0202185 A1 Sep. 14, 2006

(51) Int. Cl.
*E04H 17/00* (2006.01)

(52) U.S. Cl. ..... 256/65.01; 256/65.11; 256/65.12; 256/59

(58) Field of Classification Search ..... 256/1, 256/21, 22, 65.01, 66, 65.11, 65.02, 59, 65.12, 256/65.13, 65.09, 65.03, 65.1; 52/664, 665, 52/666, 456

See application file for complete search history.

(56) References Cited

U.S. PATENT DOCUMENTS 306,425 A * 10/1884 Poorman et al. ..... 256/66
399,021 A * 3/1889 Dailey ..... 256/48
4,175,883 A * 11/1979 Lemelson ..... 403/347
4,466,600 A * 8/1984 Tuttle ..... 256/65.11
4,609,185 A * 9/1986 Prater et al. ..... 256/65.11
4,919,394 A * 4/1990 Otte et al. ..... 256/65.06
5,272,838 A * 12/1993 Gibbs ..... 49/404
5,345,723 A * 9/1994 Gibbs ..... 49/506
5,577,714 A * 11/1996 Venegas, Jr. ..... 256/65.12
5,601,279 A * 2/1997 Schwartz et al. ..... 256/66
5,660,376 A * 8/1997 West ..... 256/22
5,664,905 A * 9/1997 Thompson et al. ..... 404/6
6,010,117 A * 1/2000 Doxey ..... 256/73
6,179,274 B1 * 1/2001 Irwin, III ..... 256/65.02
6,341,764 B1 1/2002 Conner
6,588,732 B1 * 7/2003 Caceres et al. ..... 256/19

* cited by examiner

*Primary Examiner*—Gregory J. Binda
*Assistant Examiner*—Daniel J. Mills
(74) *Attorney, Agent, or Firm*—Mark Manley

(57) ABSTRACT

A fence having tubular rails, tubular pickets and tubular posts formed from pultruded fiberglass has several advantageous features. Lightweight fiberglass components are very strong and will not rust like metal fencing and do not require frequent maintenance like wood fencing. Pultruded fiberglass components are easy to manufacture and transport and the finished fence can be assembled using conventional fasteners. Once formed the components of this fence system can be bundled in easy to ship sets for assembly in the field. The fence system adapts well to difficult yards to fence because it can be modified with conventional hand tools.

11 Claims, 7 Drawing Sheets

ORNAMENTAL FIBERGLASS FENCE

BACKGROUND OF THE INVENTION

The present device relates to decorative and ornamental fences.

The classic ornamental fence is a metal fence. The classic ornamental fence consists of panels of upright pickets connected by horizontal rails. Panels are supported by posts. The classic ornamental fence is very popular but the expense of the metal fence limits its use.

The classic ornamental fence is expensive because of the material involved in making the fence. These fences are heavy and so great care must be taken to provide posts that will be adequate to support the weight. Also the metal fences are difficult and heavy to ship and assemble. In prior art panels the pickets are typically welded to the stringers so specialized workers and equipment are needed. On the job site the panels are heavy and so a crew of workers is typically used to install the fences. Once installed the ornamental is fairly durable but does require maintenance painting to prevent corrosion of the metal panels. All this expense and labor keeps the classic beauty of the ornamental fence beyond the reach of the average home owner.

U.S. Pat. No. 6,341,764 discloses a system where the pickets pass through holes centrally through the rails. This approach requires some type of special fastener or exposed rivet head visible to both sides of the fence detracting from its appearance.

Thus it can be seen that there is a need for an improved ornamental fence that will be light weight, easy to install and that will be inexpensive to maintain while having an improved visual appearance.

SUMMARY OF THE INVENTION

The present invention provides an ornamental fence where the pickets and rails can be made from pultruded fiberglass. The pickets can be notched to accept the rails and a rivet attaches the picket to the rail in a joint that can be invisible to one side of the fence to provide for a fence that is strong, easy to ship and assemble and that is visually very clean.

A fiberglass fence includes a plurality of essentially vertical fiberglass tubular pickets, each picket including at least one notch. At least one horizontal fiberglass tubular rail has at least a portion of a wall fitting into the notch. A rivet connects the picket to the railing, the rivet passing through a hole in the rail adjacent the notch.

The method of creating a fiberglass fence including the steps of;

- pultruding at least one tubular picket and at least one tubular rail,
- cutting the tubular picket and the tubular rail to a desired length,
- cutting a notch in the tubular picket, a portion of the tubular rail fitting into the notch; and
- connecting the picket to the rail with a connector passing through the picket, through the notch and into a wall of the tubular rail.

DETAILED DESCRIPTION OF THE DEVICE

Figure 1:
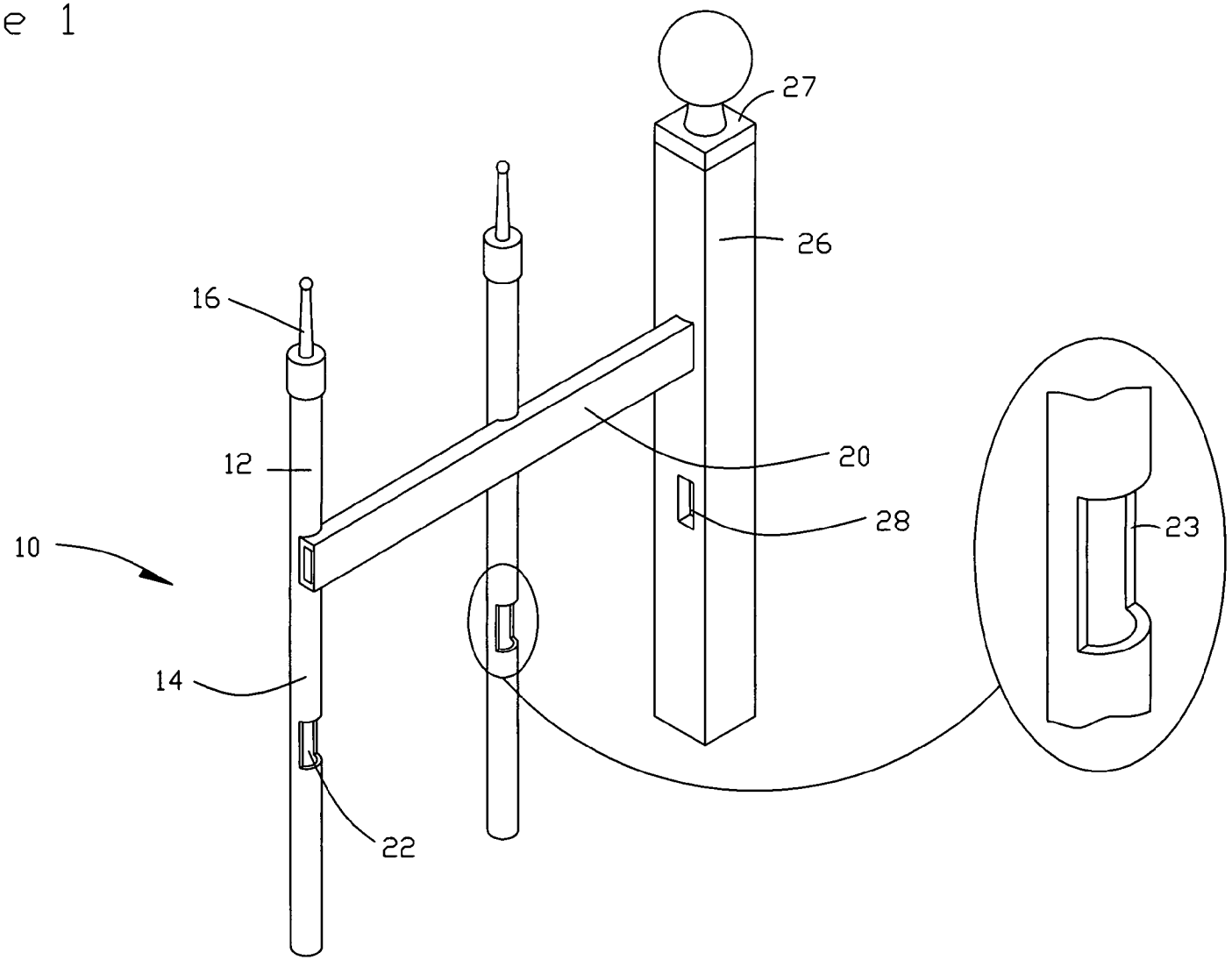
FIG. 1 shows a view of a section of one embodiment according to the present invention.

FIG. 1 shows a view of the fence 10. Fence 10 includes a series of round, essentially vertical pickets 12 that can include a tubular body 14 and a crown 16. The crowns 16 can be ornamental as well as serving to keep water out of the pickets 12. Horizontal tubular rails 20 support the pickets 12. The tubular rails 20 fit into notches 22 cut into the pickets 12. Each tubular rail 20 can have holes 40 drilled through one side of the rail wall 30 (see FIG. 2) to facilitate assembly with pickets 12. Each rail 20 is supported by a post 26. As shown in FIG. 1, holes 28 can be cut into the post 26 through which the rail 20 can pass. Each of the tubular components, pickets 12, rails 20 and posts 26 can be formed from fiberglass pultrusion. The post 26 can include a decorative cap 27. FIG. 1 includes an enlargement of the notch 22 that shows the essentially flat surfaces 23 created by the notch 22. The flat surfaces 23 allow the picket 12 to form a stable connection with the rail 20.

Figure 2:
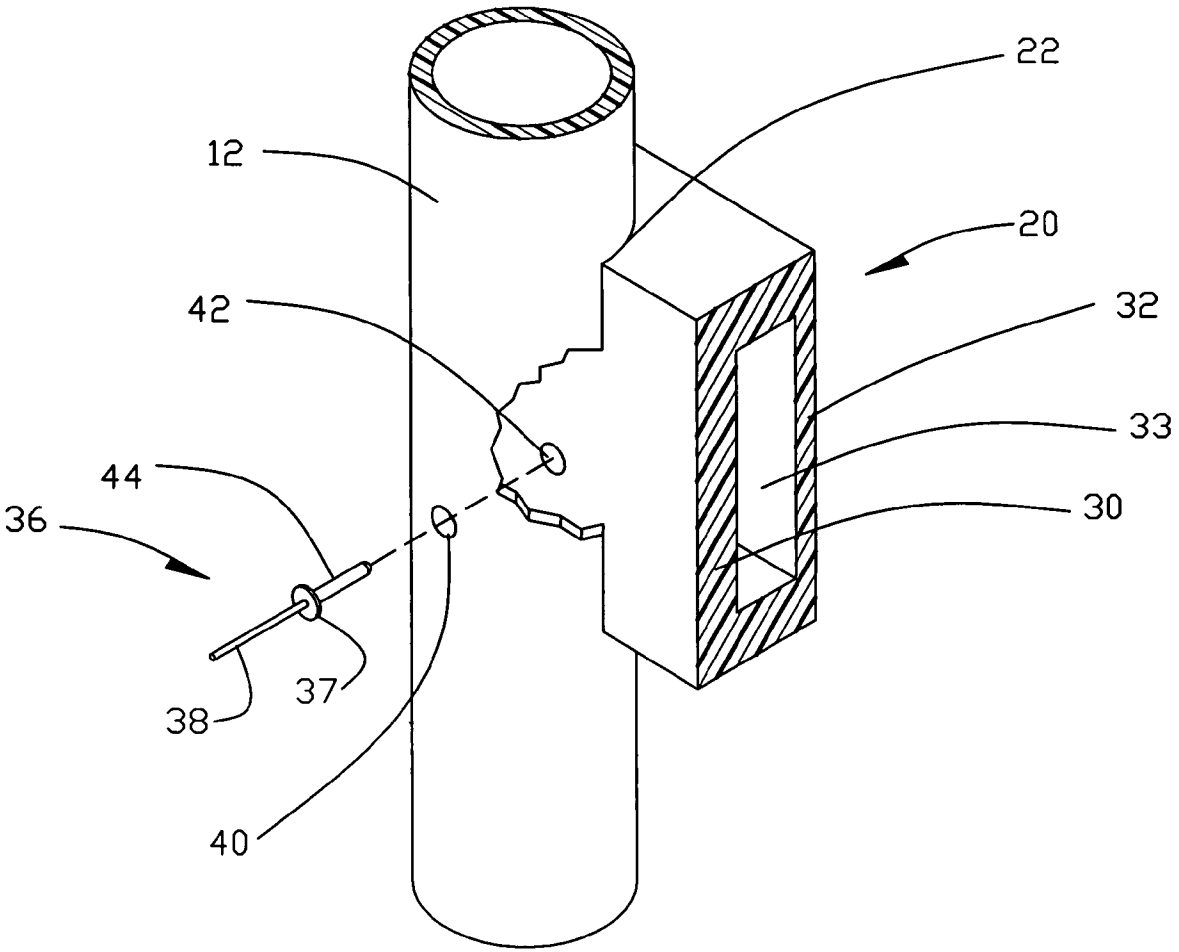
FIG. 2 shows a partially exploded view of a portion of the fence.

FIG. 2 shows details of the joints formed between the rail 20 and the pickets 12. Notch 22 can extend nearly half way into the cross-section of the picket 12. The rail 20 sits in the notch 22. The rail 20 includes a thick wall side 30 and a thin wall side 32, such that the opening 33 is offset. The thick wall side 30 being thick enough to support loading caused by fastening of the pop rivet 36 or loading such as wind loading acting on packet 12 that might be experienced by the fence 10. The thin side 32 carries essentially none of the loading associated with attaching the picket 12 with rivet 36. The thick wall side 30 accommodates a rivet 36 which passes through a hole 40 in picket 12 and through a second hole 42 in the thick wall side 30. The head portion 44 of the rivet 36 can be long enough to reach through picket 12 and thick wall 30. Once installed the rivets 36 are only visible from one side of the fence 10, rivet head 37 will not be visible to someone on the side of the fence 10 with thin wall side 32. The notch 22 provides a flat stable surface for the connection between the picket 12 and rail 20.

Figure 3:
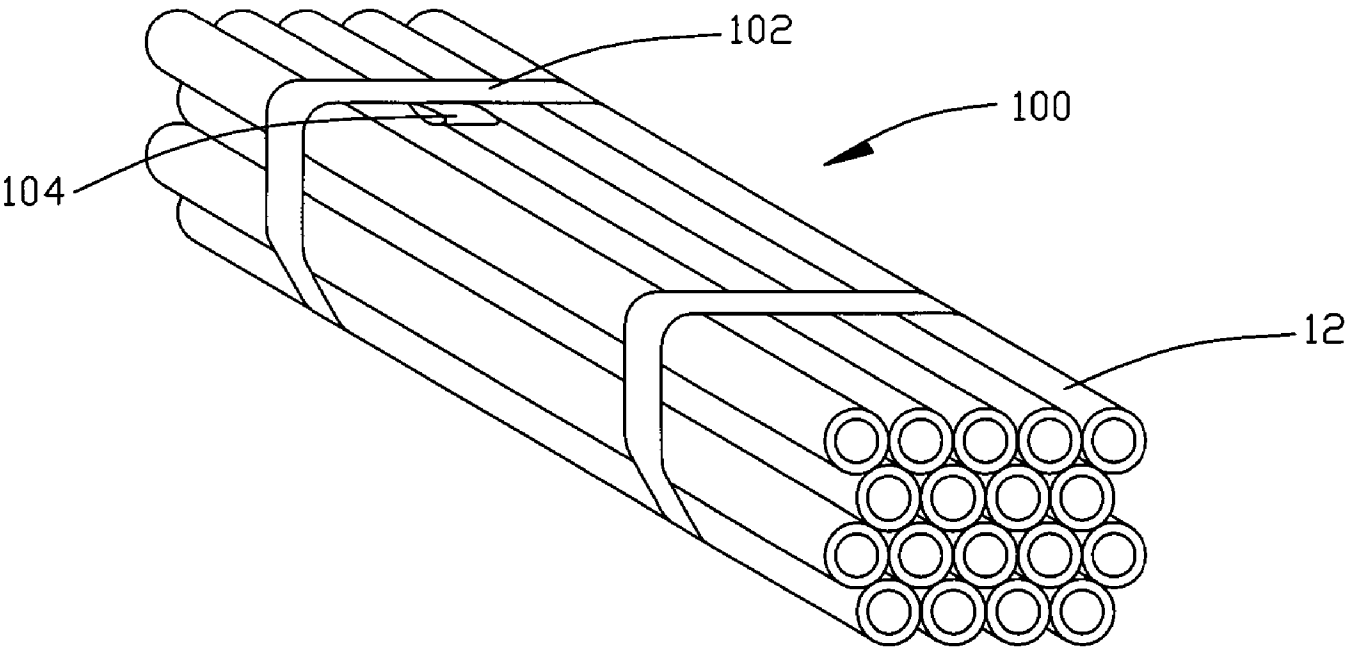
FIG. 3 shows pickets bundled for shipment.

FIG. 3 shows a bundle 100 of pickets 12. The bundles 100 as shown are easy to ship to a job site. The straps 102 hold the bundles 100 together and can hold a pouch 104 for small items such as installation instructions, not shown, or rivets 36. Rails 20 and posts 26 could also be bundled for shipment either separately or with the pickets 12. An advantage of current fence 10 is that it can easily be assembled without the need for special tools or skilled labor. By bundling pickets 12, rails 20 and posts 26 the product shipping costs can be very low. The ease of installation and low shipping costs make fence 10 a very practical system.

Figure 4:
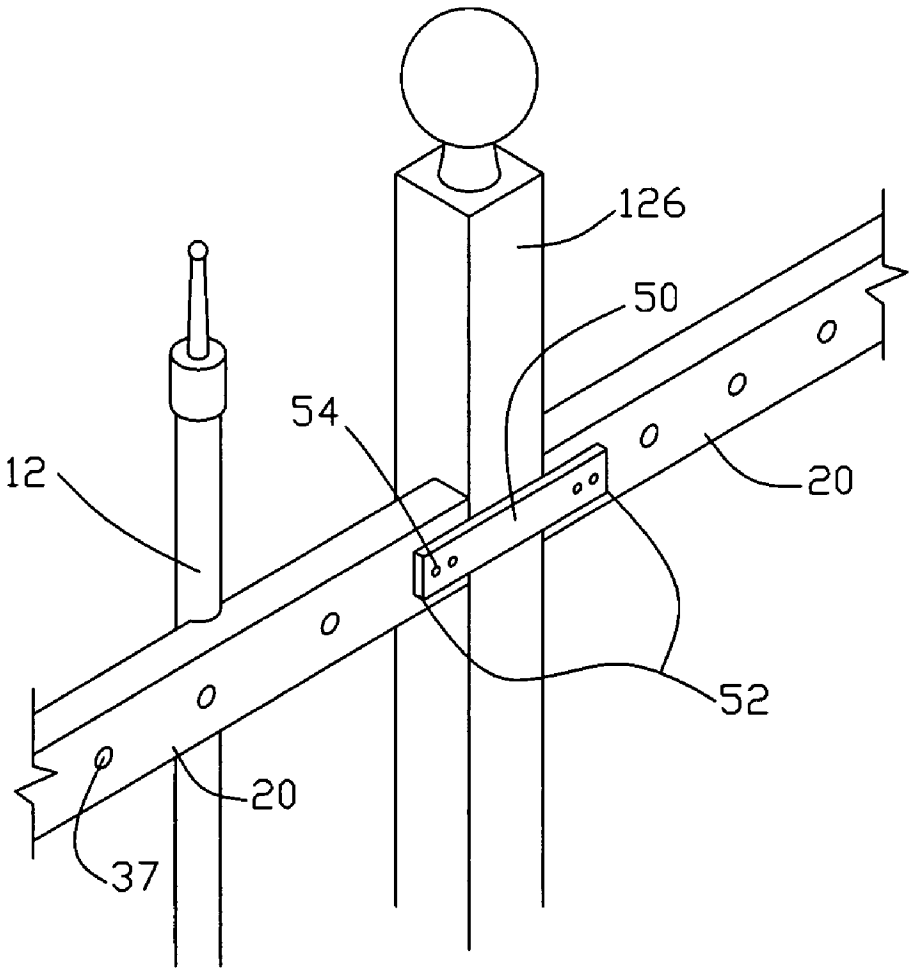
FIG. 4 shows a section of an alternate embodiment of the fence according to the present invention.

FIG. 4 shows an alternate way in which the rails 20 can be attached to a post 126. A strap 50 can extend across the post 26 with tabs 52 through which fasteners 54 can be attached. Though not shown there are a number of other ways the rails 20 can be attached to the post 26 including rivets directly through the rails 20 and into the post 126. Preferably the strap 50 would be located on the same side of the fence 10 as rivet heads 37, so that the other side of the fence 10 would be clear of any visible fasteners. Post 126 can be fiberglass or a wooden post.

Figure 5:
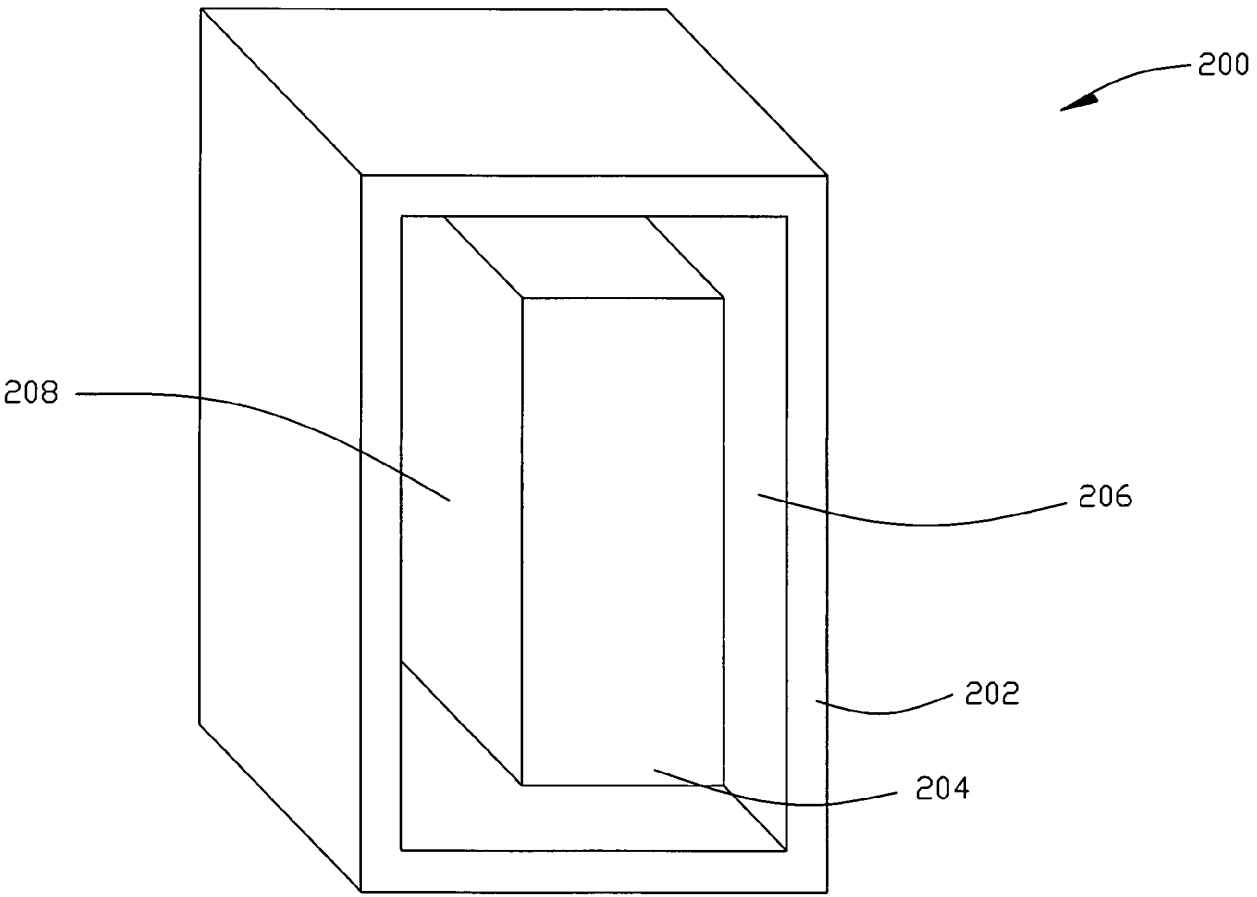
FIG. 5 shows details of the pultrusion die used to make a portion of the fence.

FIG. 5 shows a view of an outlet portion of the fiberglass pultrusion die 200 used to manufacture fiberglass rails 20. The die 200 includes an outer portion 202 having a rectangular cross section and an inner portion 204 also having a rectangular cross section. The inner portion 204 is off-set in the outer portion 202 creating a narrow opening 206 and a wide opening 208. Fiberglass is pultruded through the die 200 creating a rail 20 with a thick wall 30 and a thin wall 32, the thick wall 30 corresponding to the wide opening 208. It will be understood by those skilled in fiberglass pultrusion that the inner portion can be supported within the die 200 upstream from the die outlet. Fiberglass strands and liquid resin enter the die 200 and can emerge from the die 200 as a soft solid having a cross sectional shape matching the open portion of die 200. It will be understood by those skilled in the art that the pickets 12 and posts 26 can also be created by pultrusion of fiberglass. Once pultruded and cooled, the rails 20 can be cut to any desired length. After pultrusion, the pickets can have notch 22 cut into them and hole 40 drilled into them. Once cut to length and machined the pickets 12, rails 20 and posts 26 can be bundled for shipment.

Figure 6:
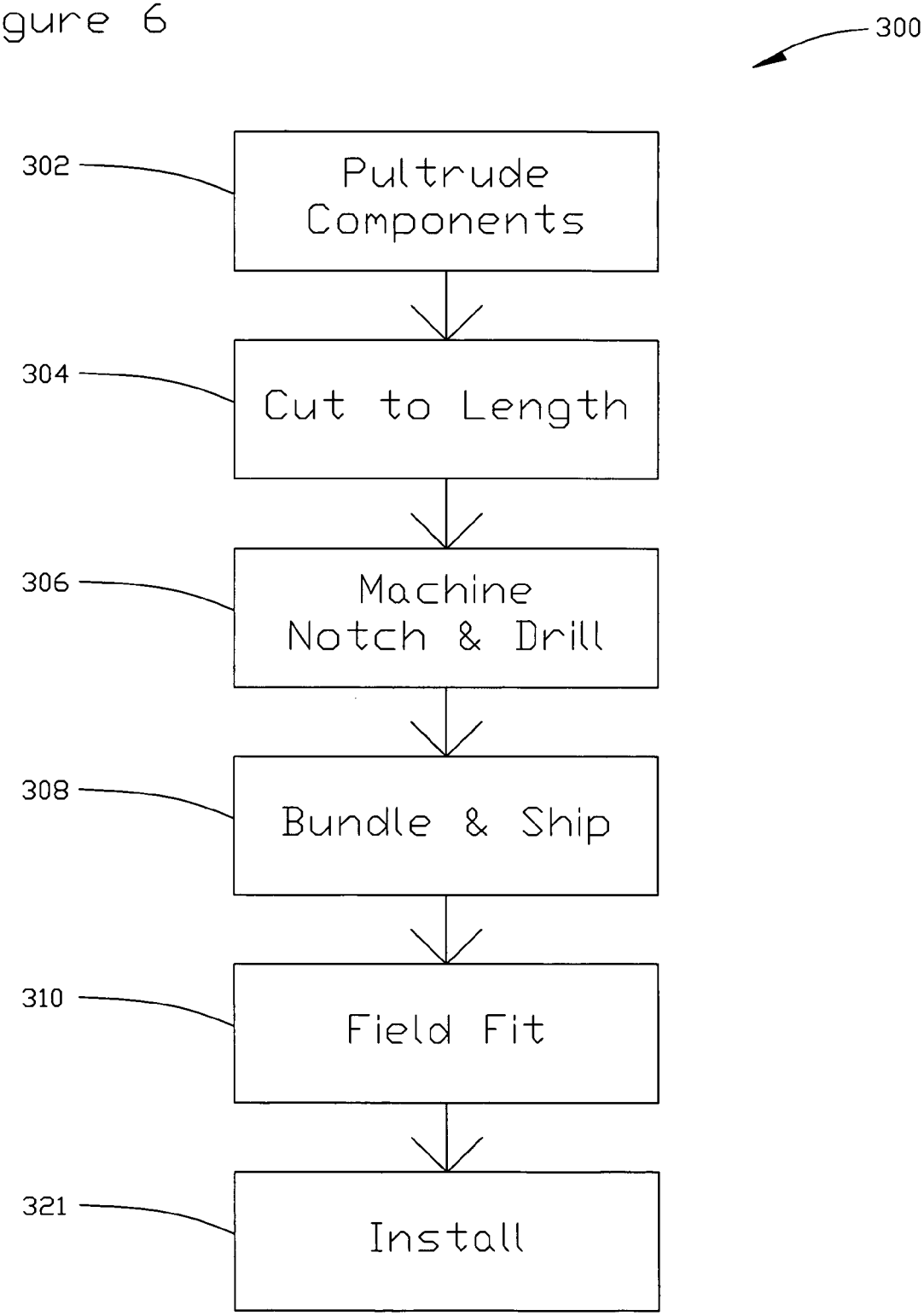
FIG. 6 shows, steps in the method of making the fence.

The pultrusion die 200 can be used in the method 300 of creating the fence 10 as shown in FIG. 6. In the first step 302, fiberglass fibers and resin, not shown, are pultruded 302 into long components including pickets 12, rails 20 and posts 26. The rail 20 can be pultruded with one wall 30 thickness greater than another wall thickness 32. Pickets 12, rails 20 and posts 26 are cut to length 304. Then the pickets 12, rails 20, and posts 26 can be machined 306. For example, the notch 22 can be cut into the rail 20 and the hole 40 can be drilled into the rail 20. The fence materials can then be bundled and shipped in step 308 to a site and the fence can be field fit 310 and installed 321.

Figure 7:
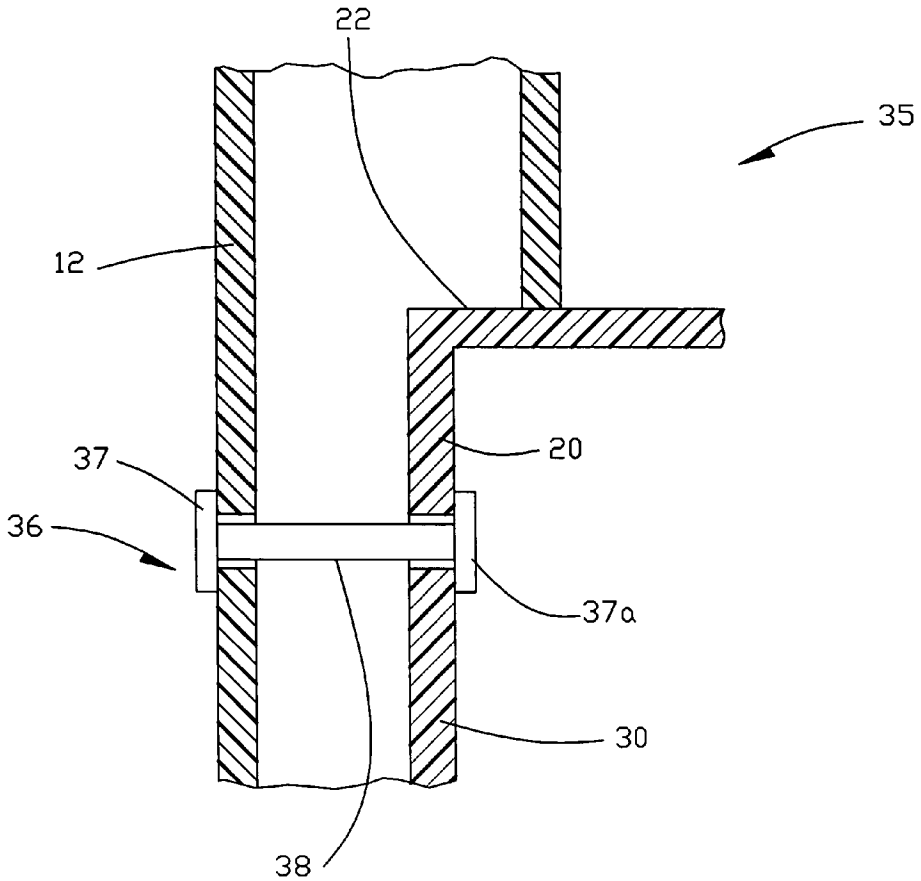
FIG. 7 shows a pultrusion die used to make a portion of the fence.

FIG. 7 shows details of the connection between the picket 12 and the rail 20. The rivet 36, see FIG. 2, has now been connected. Rivet head 37*a* has formed inside tubular rail 20, while rivet head 37 rests against picket 12. The heads 37 and 37*a* are connected by the shank portion 38 of the rivet 36.

Once shipped, step 308, the bundles 100 will arrive for installation. Posts 26 can be placed and rails 20 can be attached to the posts 26. Pickets 12 can be placed with notches 22 on the rails 20. Holes 40 can be used as a pilot to drill hole 42 into the rail 20 at the time of installation to field fit 310 the pickets 12 to the rails 20 if a custom picket spacing is desired for example. Rivets 36 can then be used to connect pickets 12 to the rails 20. An advantage of the fiberglass fence 10 over iron, steel or aluminum can be the ease with which components can be altered in the field. For example, pickets 12, rails 20 and posts 26 can be easily cut or drilled with conventional hand tools, not shown, available to skilled and even relatively unskilled fence installers such as those who have never installed a fence. Because the rails 20 and pickets 12 are very light weight they can be retrofit to existing wood posts 126. In this manner a home owner with a deteriorating wood fence could replace their existing wood fence, not shown, with fiberglass ornamental rails 20 and pickets 12 without removing or replacing posts 126 if those existing posts are in good condition.

Though shown as tubular pickets 12 having a circular cross section, it will be understood that pickets could have a variety of cross sectional shapes including, for example square. It will also be understood that the tubular rails 20 and posts 26 could have a variety of cross sectional shapes.

Having thus described the invention, it should be understood, of course, that the foregoing relates to exemplary embodiments of the invention and that modifications may be made without departing from the spirit and scope of the invention as set forth in the following features.

The invention claimed is:

1. A fiberglass fence including;

a plurality of essentially vertical fiberglass tubular pickets each having a circular cross section, each of said pickets including at least one notch taken from said tubular picket creating a flat surface, at least one horizontal fiberglass tubular rail, at least a portion of a wall of said rail fitting into said notch against said flat surface, a rivet connecting said picket to said rail, said rivet passing through a hole in said rail adjacent said notch and into an interior space of said rail, said tubular rail having a rectangular cross section with an offset opening formed by a thick wall adjacent said at least one notch and a thin wall opposite said notch.

2. The fiberglass fence of claim 1 wherein said hole and rivet pass through said thick wall.

3. The fiberglass fence of claim 1 wherein said picket is held to said rail by said rivet having a first head resting against said picket and a second head on an inside surface of said tubular rail.

4. A fiberglass fence including;

a plurality of essentially vertical fiberglass tubular pickets each having a circular cross section, each of said pickets including at least one essentially flat surface created by a notch in said tubular picket, at least one horizontal fiberglass tubular rail, at least a portion of a wall of said rail fitting onto said flat surface, a connection between each of said plurality of pickets and said tubular rail, wherein said tubular rail has a rectangular cross section with an offset opening formed by a thick wall adjacent said at least one notch and a thin wall opposite said thick wall, wherein said connection includes a fastener passing through a hole in said picket and into an interior space of said rail.

5. The fiberglass fence of claim 4 wherein said offset opening is rectangular.

6. The fiberglass fence of claim 4 wherein said fastener includes a rivet passing through said picket and into said thick wall and wherein a head of said rivet is hidden inside said tubular rail.

7. The fiberglass fence of claim 4 wherein said tubular pickets include a crown.

8. A fiberglass fence including;

a plurality of tubular pickets each having a circular cross section, each of said tubular pickets including at least one essentially flat surface created by a notch, at least one horizontal fiberglass tubular rail, at least a portion of a wall of said rail fitting onto said flat surface, a connection between each of said plurality of pickets and said tubular rail wherein said tubular rail has a cross section with an offset opening formed by a thick wall adjacent said flat surface and a thin wall opposite said flat surface, wherein said connection includes a fastener passing through a hole in said picket and into an interior space of said rail.

9. The fiberglass fence of claim 8 including a plurality of tubular fiberglass posts, each said tubular post including a hole passing through said post, said rail including an end portion, said end portion held in said hole in said post to support said rail.

10. The fiberglass fence of claim 9 wherein said flat surface is formed as part of said notch cut into the picket.

11. The fiberglass fence of claim 9 wherein said fastener passes through said picket and into said thick wall and wherein a portion of said fastener is hidden inside said tubular rail.

* * * * *